US006374453B1

(12) United States Patent
Kim

(10) Patent No.: US 6,374,453 B1
(45) Date of Patent: Apr. 23, 2002

(54) CONVERTIBLE VACUUM CLEANER

(76) Inventor: Young S. Kim, 1612 Corlevia, Los Altos, CA (US) 94024

( * ) Notice: Subject to any disclaimer, the term of this patent is extended or adjusted under 35 U.S.C. 154(b) by 49 days.

(21) Appl. No.: 09/653,753

(22) Filed: Sep. 1, 2000

Related U.S. Application Data

(60) Provisional application No. 60/152,048, filed on Sep. 2, 1999.

(51) Int. Cl.[7] ..... A47L 5/28; A47L 5/32

(52) U.S. Cl. ..... 15/328; 15/333; 15/390; 15/410

(58) Field of Search ..... 15/328, 329, 333, 15/390, 410

(56) References Cited

U.S. PATENT DOCUMENTS 1,997,754 A * 4/1935 Sharp ..... 15/314
4,393,536 A * 7/1983 Tapp ..... 15/327.5
4,670,937 A * 6/1987 Sumerau et al. ..... 15/329
5,836,047 A * 11/1998 Lee et al. ..... 15/328
5,842,254 A * 12/1998 Lee ..... 15/327.2
6,058,559 A * 5/2000 Yoshimi et al. ..... 15/323
6,094,775 A * 8/2000 Behmer ..... 15/327.1
6,098,243 A * 8/2000 Kim ..... 15/332
6,295,692 B1 * 10/2001 Shideler ..... 15/327.5

* cited by examiner

*Primary Examiner*—Chris K. Moore
(74) *Attorney, Agent, or Firm*—Flehr Hohbach Test Albritton & Herbert LLP

(57) ABSTRACT

A vacuum cleaner of the type which includes a canister which when upright the vacuum cleaner is operated as an upright vacuum cleaner, or, when tilted down, the vacuum cleaner is operated as a canister-type vacuum cleaner.

5 Claims, 5 Drawing Sheets

CONVERTIBLE VACUUM CLEANER

RELATED APPLICATIONS

This application claims priority to Provisional Application Serial No. 60/152,048 filed Sep. 2, 1999.

BRIEF DESCRIPTION OF THE INVENTION

This invention relates generally to vacuum cleaners, and more particularly to a vacuum cleaner which is convertible from an upright-type vacuum cleaner to a canister-type vacuum cleaner.

BACKGROUND

Generally, vacuum cleaners are of two types, upright and canister, each of which includes a canister body which houses a dust bag, motor, fan, etc. The upright type comprises a head which includes a brush driven by the motor. The motor also drives a fan that creates a partial vacuum and carries outside air, dust and debris into the dust bag. The canister extends upwardly and receives a handle. The head moves over the surface to be cleaned drawing the dust and debris into the dust bag. Canister-type vacuum cleaners also include a canister with vacuum bag and motor. An outwardly-extending vacuum hose is attached to the canister. Various appliances may be connected to the hose. The vacuum hose drags the canister around as the operator moves the hose to clean in various places.

OBJECTS AND SUMMARY OF THE INVENTION

It is a general object of the present invention to provide a convertible vacuum cleaner which, in a first position operates as an upright vacuum cleaner and, in a second position operates as a canister-type vacuum cleaner.

It is a further object of the present invention to provide a convertible vacuum cleaner which is easy to convert and operate.

There is a provided a vacuum cleaner which includes a head pivotally secured to a canister with the canister extending upward from the head in a first position and, in a second position, the canister is pivoted so that it rests on the floor. In the first position, a hollow handle is secured to the canister and the vacuum bag is connected to the head by a flexible hose. In the second position, the hose is disconnected from the head and connected to the hollow handle which acts as a wand.

BRIEF DESCRIPTION OF THE DRAWINGS

The foregoing and other objects of the invention will be more clearly understood from the description to follow when read in conjunction with the accompanying drawings of which.

DESCRIPTION OF THE PREFERRED EMBODIMENTS

Figure 1:
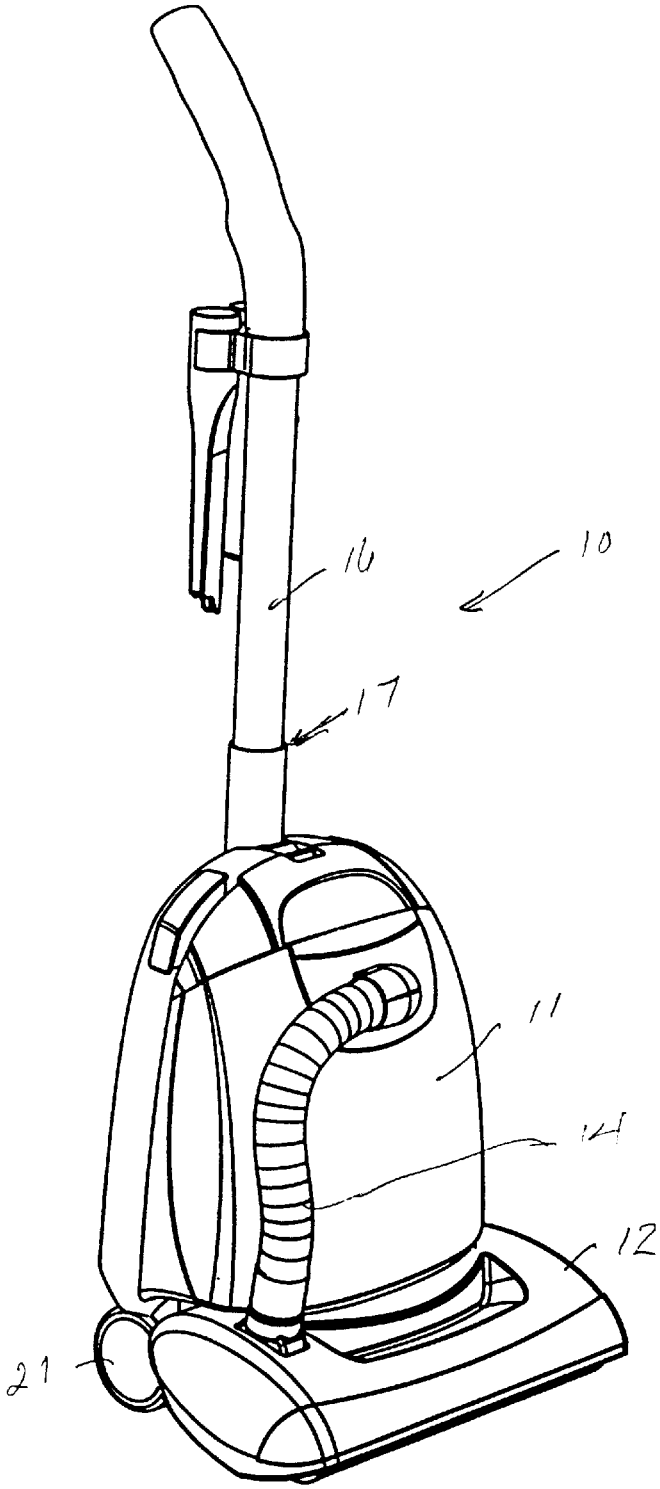
FIG. 1 is a front perspective view of the vacuum cleaner in an upright position.
Figure 2:
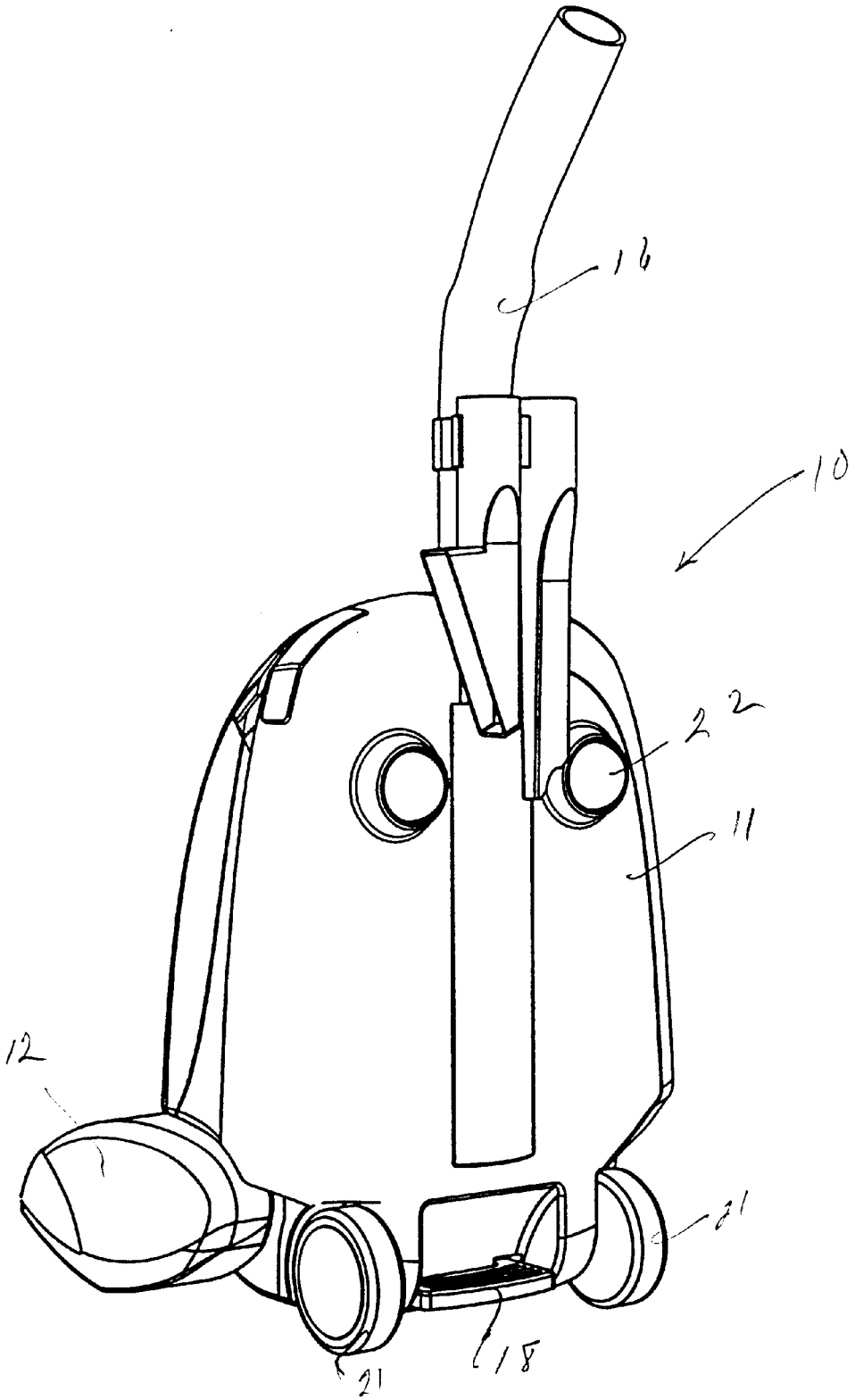
FIG. 2 is a rear perspective view of the vacuum cleaner in the upright position.
Figure 3:
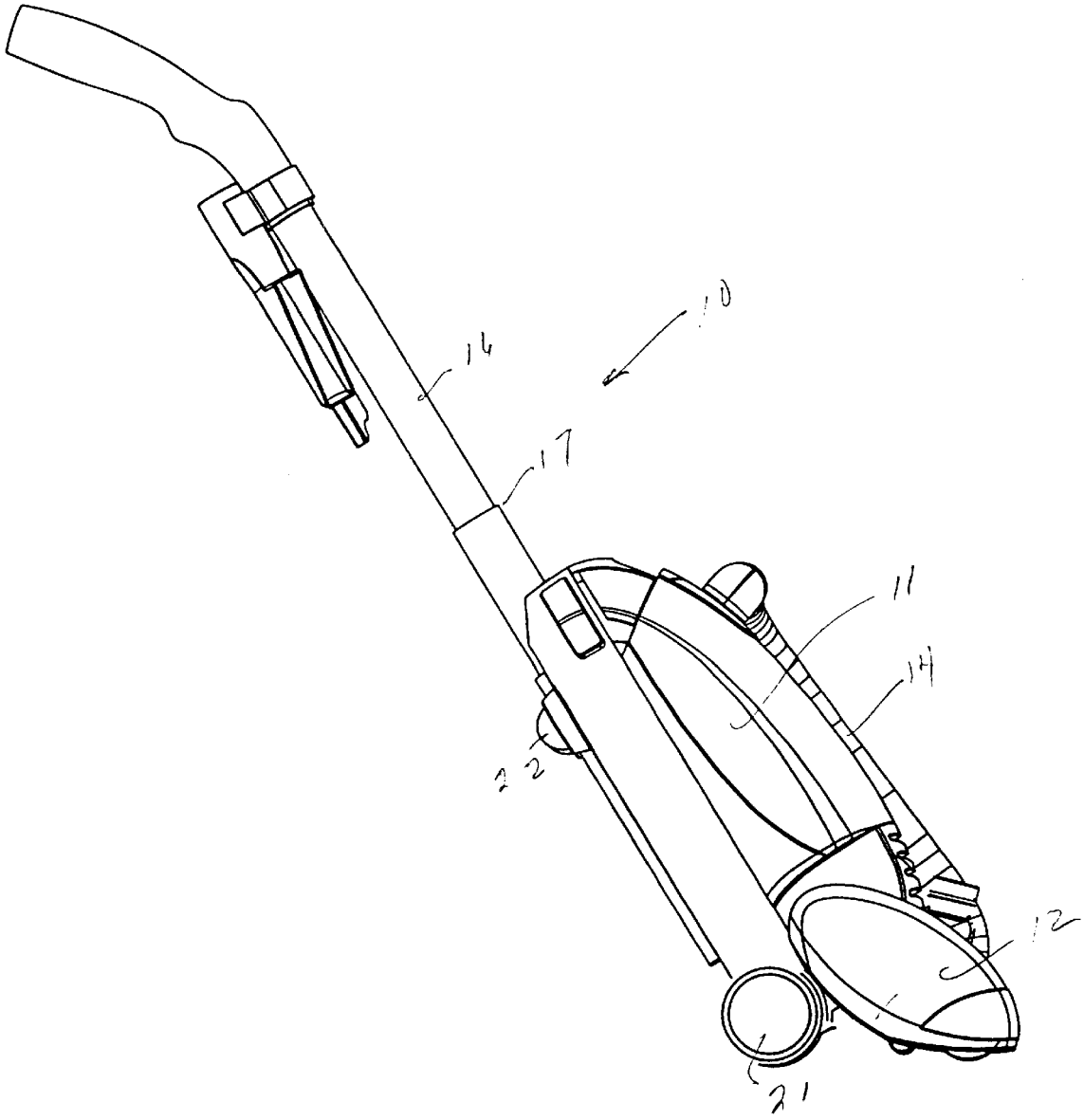
FIG. 3 is a side view of the upright vacuum cleaner.

Referring to FIGS. 1–4, the vacuum cleaner 10 includes a canister body 11 which houses a dust bag, and a head 12 pivotally secured to the canister. The head includes a brush 13, FIGS. 5 and 6, and is connected to the dust bag via a flexible hose 14 connected between the head and the canister. Dust, debris and the like are drawn through the head and into the dust bag. A detachable handle 16 is suitably secured to the canister as by sliding into tubular mount 20. Preferably the handle is hollow and telescoped schematically as shown at 17, whereby it can be extended or shortened to fit a particular operator. The bottom of the canister is provided with wheels 21 which engage the floor when the vacuum cleaner is operated as an upright vacuum cleaner. The back of the canister includes a foot-operated switch 18 for turning on and off the motor when the vacuum cleaner is operated in the upright position. The bottom of the canister includes rollers or wheels 21 which engage the floor when the vacuum cleaner is operated as an upright vacuum cleaner. The back of the canister includes rollers or wheels 22 which, along with the wheels 21, engage the floor when the vacuum cleaner is operated as a canister-type vacuum cleaner. This permits the operator to drag the canister as the wand is used.

Figure 5:
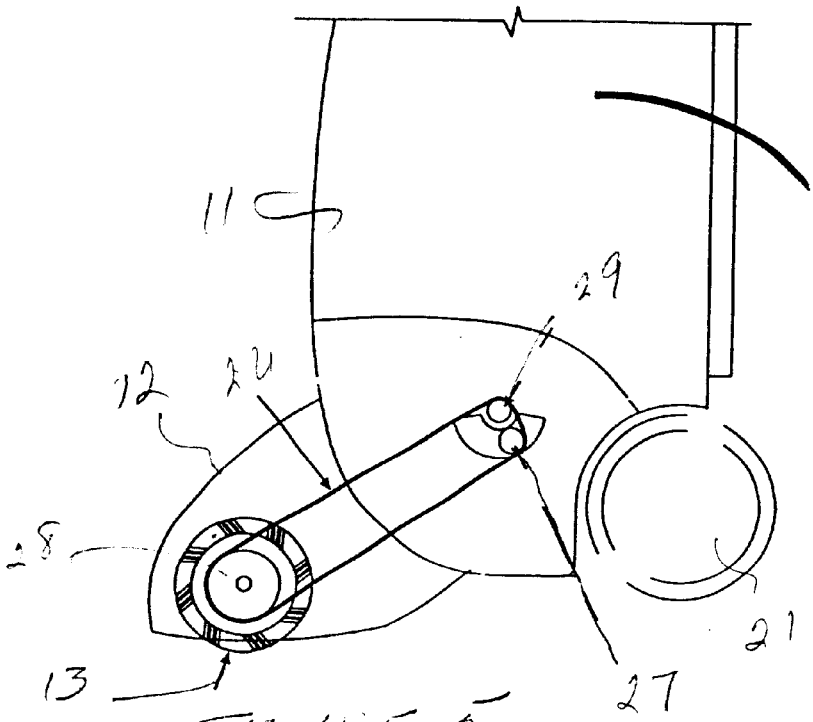
FIG. 5 illustrates the brush drive belt in drive position for upright operation of the vacuum cleaner.
Figure 6:
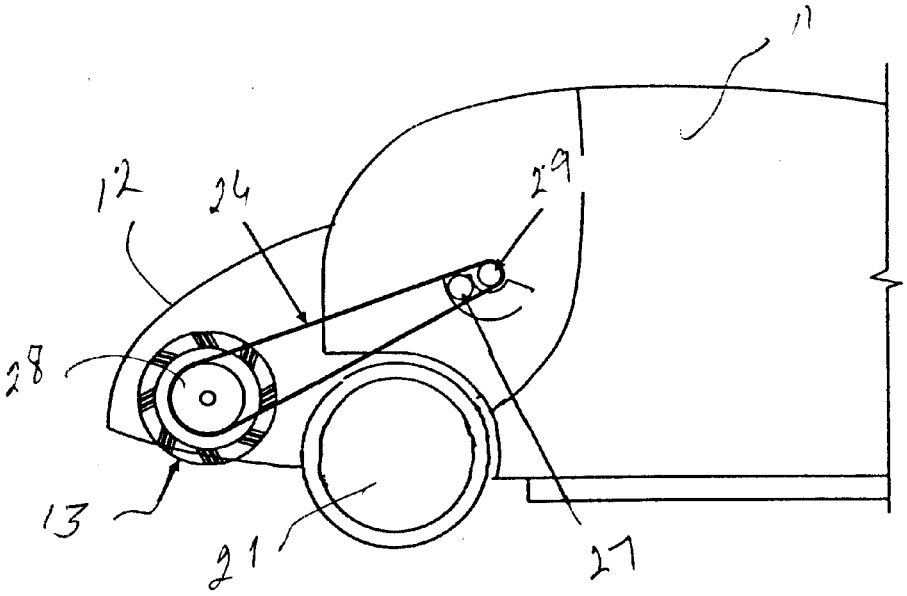
FIG. 6 illustrates the brush drive belt disengaged from the belt drive for canister-type operation of the vacuum cleaner.

In the upright position, FIG. 5, the brush 13 is driven by a belt 26 which extends over drive shaft 27 driven by the motor (not shown). The belt wraps over the drive pulley 28 and idle pulley 29 mounted on the pivot which allows the head to tilt or rotate.

Figure 4:
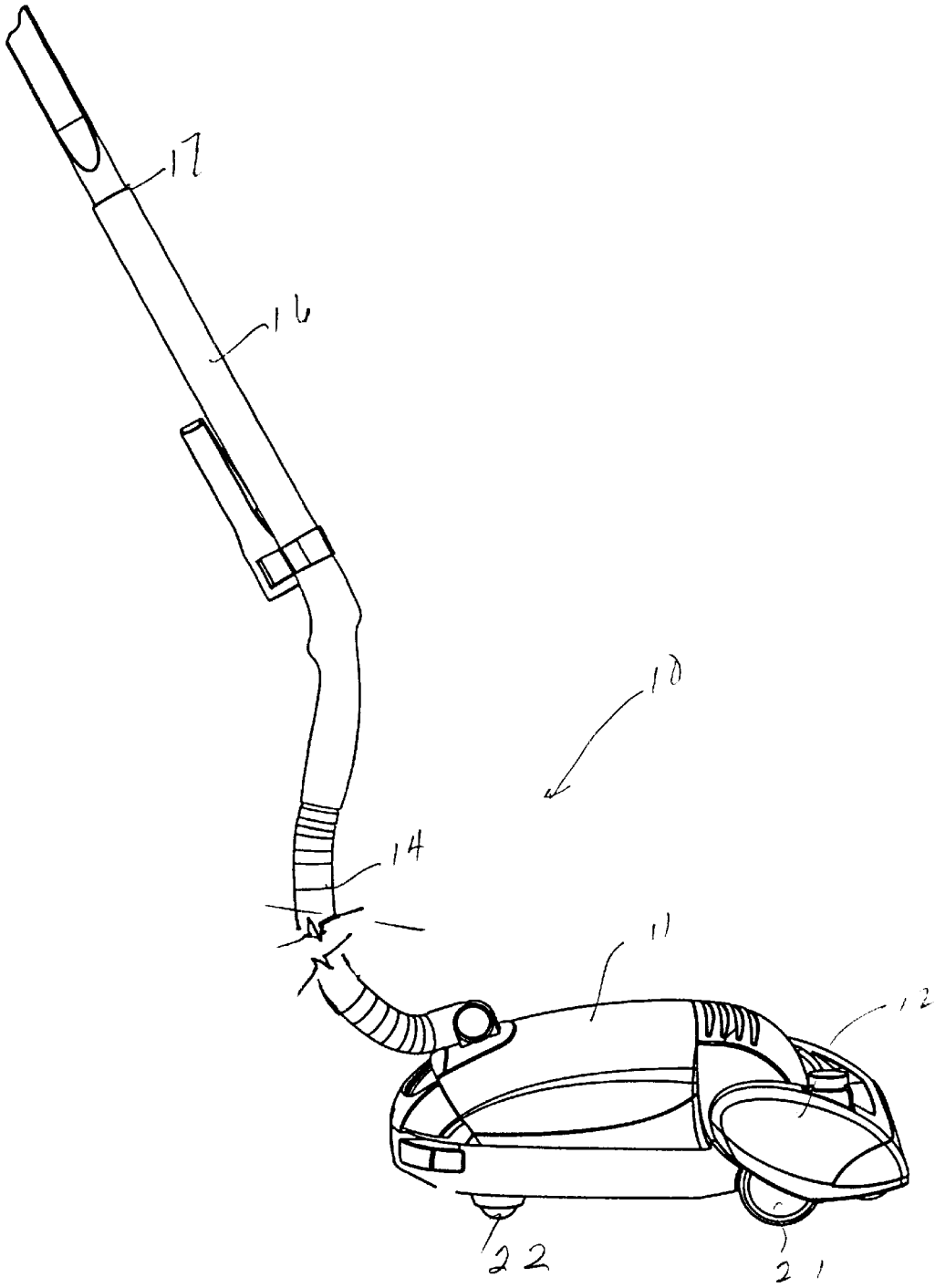
FIG. 4 is a perspective view of the vacuum cleaner with the head tilted to form a canister-type vacuum cleaner.

To operate as a canister for vacuum cleaning, the flexible hose is disconnected from the head and connected to the wand, FIG. 4, whereby to provide a vacuum at the end of the wand to vacuum debris and dirt into the vacuum cleaner. The end of the wand may accommodate a number of different appliances. The wand comprises the handle 16 in a reversed orientation with the hand-held part of the handle secured to the flexible hose and the other end of the hose secured to the canister. The handle is extended to vacuum various areas with the canister trailing when the vacuum cleaner is operated as a canister-type vacuum cleaner.

The following procedure is illustrative of converting from an upright vacuum cleaner to a canister-type vacuum cleaner. Step 1. The handle 16 is removed from the canister body 11 by pulling it out of the mount 20. Step 2. The canister body back is tilted until the wheels 22 engage the floor. The brush head swivels or pivots until the drive belt 26 no longer engages the drive shaft 27. Step 3. The end of the flexible hose is removed from the head 12 and attached to the end of the hollow handle which can now be used as a wand.

Thus there has been provided a simple easy-to-operate convertible vacuum cleaner, which, in one position of the head, operates as an upright vacuum cleaner, and, in a second position of the head, operates as a canister-type vacuum cleaner with the head brushes disabled.

The foregoing descriptions of specific embodiments of the present invention are presented for the purposes of illustration and description. They are not intended to be exhaustive or to limit the invention to the precise forms disclosed; obviously many modifications and variations are possible in view of the above teachings. The embodiments were chosen and described in order to best explain the principles of the invention and its practical applications, to thereby enable others skilled in the art to best utilize the invention and various embodiments with various modifications as are suited to the particular use contemplated. It is intended that the scope of the invention be defined by the following claims and their equivalents.

What is claimed is:

1. A vacuum cleaner comprising:

a canister which houses a drive motor and vacuum bag, a head pivotably secured to said canister so that in a first position the head engages the floor and the vacuum cleaner operates as an upright vacuum cleaner, and, in a second position, the canister is lowered and the vacuum cleaner operates as a canister vacuum cleaner, a flexible hose having one end connected to said canister and vacuum bag, and, in the first position of said head, the other end is connected to the head, and in the second position of the head the flexible hose is connected to a wand.

2. A vacuum cleaner as in claim 1 including a hollow handle detachably secured to said canister so that it serves as a handle for upright operation of the vacuum cleaner when attached, and serves as a wand for canister-type vacuum cleaner when detached from said canister and attached to the other end of the flexible hose.

3. A vacuum cleaner as in claims 1 or 2 in which a rotatable brush is mounted in said head and drive means are provided to drive the brush from said drive motor, said drive means being engaged when the head is in the first position and disengaged when the head is in the second position.

4. A vacuum cleaner comprising:

a canister which houses a drive motor and vacuum bag, a head pivotably secured to said canister so that in a first position the head engages the floor and the vacuum cleaner operates as an upright vacuum cleaner, and, in a second position, the canister is lowered and the vacuum cleaner operates as a canister vacuum cleaner, a flexible hose having one end connected to said canister and vacuum bag, and, in the first position of said head, the other end is connected to the head, and in the second position of the head, the flexible hose is connected to a wand, a rotatable brush mounted in said head, a belt engaging said brush and in the first position of said head a drive shaft whereby to rotatably drive said brush and in second position of said head said belt is disengaged from the drive shaft.

5. A vacuum cleaner as in claim 4 including a hollow handle detachably secured to said canister so that it serves as a handle for upright operation of the vacuum cleaner when attached, and serves as a wand for canister-type vacuum cleaner when detached from said canister and attached to the other end of the flexible hose.

* * * * *